US011087710B2

(12) United States Patent
Hou et al.

(10) Patent No.: US 11,087,710 B2
(45) Date of Patent: Aug. 10, 2021

(54) DYNAMIC VCOM COMPENSATION

(71) Applicant: Apple Inc., Cupertino, CA (US)

(72) Inventors: Pei-Yu Hou, Sunnyvale, CA (US); Yang Li, Sunnyvale, CA (US); Hao-Lin Chiu, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/147,045

(22) Filed: Sep. 28, 2018

(65) Prior Publication Data

US 2019/0228732 A1 Jul. 25, 2019

Related U.S. Application Data

(60) Provisional application No. 62/619,584, filed on Jan. 19, 2018.

(51) Int. Cl.
*G09G 3/36* (2006.01)
*G09G 3/3225* (2016.01)

(52) U.S. Cl.
CPC ..... *G09G 3/3696* (2013.01); *G09G 3/3655* (2013.01); *G09G 3/3225* (2013.01); *G09G 2310/0243* (2013.01); *G09G 2310/06* (2013.01); *G09G 2310/08* (2013.01); *G09G 2320/0233* (2013.01); *G09G 2320/0247* (2013.01)

(58) Field of Classification Search
CPC ..... G09G 3/3696; G09G 3/3655; G09G 2320/0247; G09G 3/3225; G09G 2310/06; G09G 2310/08; G09G 2310/0243; G09G 2320/0233
See application file for complete search history.

(56) References Cited

U.S. PATENT DOCUMENTS

2007/0024565 A1* 2/2007 Choi ..... G09G 3/3655 345/98
2009/0002303 A1 1/2009 Huang
2012/0139886 A1* 6/2012 Lee ..... G09G 3/3677 345/209
2012/0249508 A1* 10/2012 Hsu ..... G09G 3/344 345/211
2013/0314393 A1 11/2013 Min et al.
(Continued)

FOREIGN PATENT DOCUMENTS

CN 1904992 A 1/2007
CN 101303491 A 11/2008
CN 101311779 A 11/2008
(Continued)

OTHER PUBLICATIONS

Utility Model Patent Evaluation Report (UMPER) for Chinese Patent Application No. 2019200599726 dated Jan. 9, 2020; 10 pgs.

*Primary Examiner* — Jonathan A Boyd
(74) *Attorney, Agent, or Firm* — Fletcher Yoder P.C.

(57) ABSTRACT

A display includes a plurality of pixels grouped into a plurality of lines of pixels. Each line of pixels of the plurality of lines comprises a group of pixels of the plurality of pixels that are coupled to a common scan line as well and that are coupled to different data lines to individually activate each pixel of the group of pixels. The display also includes a common voltage (VCOM) driving circuit configured to receive a waveform and drive the waveform to the display as a VCOM having a value tailored to an individually activated pixel of the group of pixels.

20 Claims, 7 Drawing Sheets

(56) References Cited

U.S. PATENT DOCUMENTS

2013/0328855 A1 12/2013 Li et al.

FOREIGN PATENT DOCUMENTS

| | | | |
|---|---|---|---|
| CN | 102270431 | A | 12/2011 |
| CN | 103295540 | A | 9/2013 |
| CN | 106887215 | A | 6/2017 |
| CN | 206421807 | U | 8/2017 |

* cited by examiner

DYNAMIC VCOM COMPENSATION

CROSS REFERENCE TO RELATED APPLICATIONS

The application is a Non-Provisional application claiming priority to U.S. Provisional Patent Application No. 62/619,584, entitled "Dynamic VCOM Compensation," filed Jan. 19, 2018, which is herein incorporated by reference.

BACKGROUND

The present disclosure relates generally to electronic devices and, more particularly, to reducing display artifacts, such as flicker, in displays of the electronic devices.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Displays, such as liquid crystal displays (LCDs), are commonly used as screens or displays for a wide variety of electronic devices, including consumer electronics such as televisions, computers, and handheld devices (e.g., cellular telephones, audio and video players, gaming systems, and so forth). Such devices typically provide a flat display in a relatively thin package that is suitable for use in a variety of electronic goods.

LCD panels include a backlight and an array of pixels. The pixels contain liquid crystal material that can modulate the amount of light that passes from the backlight through the pixels. By causing different pixels to emit different amounts of light, the pixels may collectively display images on the display. Modulating the amount of light that passes through each pixel involves controlling electric fields applied to the liquid crystal material of each pixel. In particular, each pixel may have a pixel electrode that stores a data voltage. Groups of pixels may share a common electrode that provides a common voltage (VCOM) voltage. The voltage difference between the data voltage on the pixel electrode and the common voltage on the common electrode creates an electric field in each pixel. The electric field causes the liquid crystal material to modulate the amount of light. Indeed, the liquid crystal molecules in the liquid crystal material rotate in a way that causes a particular amount of light to pass through the pixel; this rotation depends on the magnitude of the electric field. That is, what matters is the magnitude of the voltage difference such that a positive voltage difference or a negative voltage difference of the same magnitude will generally cause the liquid crystal material to emit the same amount of light through the pixel. Thus, controlling the magnitude of the voltage difference between the pixel electrode and the common electrode controls the amount of light that passes through each pixel.

During operation, a display may experience kickback, which may be characterized as a reduction of the voltage (e.g., positive or negative) applied to the pixels in the display. As a display is typically driven alternatingly with positive and negative voltages, and since both the positive and negative voltages are moving toward negative (e.g., are being reduced via kickback), a center value of the positive and negative voltage will also be reduced. This may cause the common voltage (VCOM) to be different from the expected common voltage level (e.g., a desired VCOM level will be at the center value of the positive and negative voltages added to the pixel). Thus, the magnitude of the positive voltage with respect to VCOM and the magnitude of the negative voltage with respect to VCOM may be different. Since a display is typically driven by positive and negative voltages alternatively, this may cause the pixels of the display to emit light differently during positive and negative frames (e.g., when the positive and the negative voltages are applied), which can, therefore, produce visual artifacts, such as flicker, etc. that may be identifiable by a user.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to systems and methods of accounting for a voltage differences on a common electrode of a display. In particular, dynamic adjustment of a common voltage (VCOM) applied at pixels of the display to allow for compensation of, for example, non-uniformity across the display (e.g., across a panel of the display). VCOM non-uniformity may be caused by non-uniformity of an amount of kickback coupled to the pixel at different LCD locations, due to, for example, a lack of material and/or electrical uniformity in a display. Traditional direct current VCOM transmissions (e.g., transmission of one static VCOM level across a display) may lead to the generation of artifacts since, due to non-uniformity of the display, it may be difficult to generate and transmit a single VCOM level that matches a desired VCOM for each pixel of the display. Accordingly, in some embodiments, a VCOM may be generated and transmitted to the display whereby the VCOM is different at different location. Furthermore, the VCOM may be generated and transmitted as changing dynamically, for example, in conjunction with gate scanning of the display, so every pixel of the display may receive a compensated VCOM that approaches or is its desired Optimal VCOM. In this manner, kickback induced VCOM non-uniformity may be compensated for and the related visual artifacts may be minimized and/or eliminated, thus improving user experience.

In some embodiments, single or multiple drivers to vary the VCOM at a line-to-line basis to allow for driving of the VCOM to particular levels associated with the various lines of pixels. Furthermore, synchronizing the VCOM as a line-to-line adjustment to the panel gate scanning may allow only the active pixel to receive a locally compensated VCOM. In some embodiments, multiple driving points can be used anywhere on the panel to compensate complex non-uniformity profile.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Present embodiments are generally directed to accounting for non-uniformities in a common voltage (VCOM) of a display. For example, dynamic adjustment of VCOM levels and reference points across partitions may be implemented to compensate for VCOM non-uniformities of a display. In one embodiment, dynamically adjusting the VCOM to compensate for VCOM non-uniformity across the whole panel may be accomplished through the use of single/multiple drivers to vary the VCOM on a line-to-line basis, thus allowing for driving of the VCOM to prescribed local values. Furthermore, a controller may operate to synchronize the VCOM line-to-line adjustment to the panel gate scanning, so that only a particular active pixel sees a local compensated VCOM value. In some embodiments, multiple driving points can be used anywhere on the panel to compensate complex non-uniformity profile.

Figure 1:
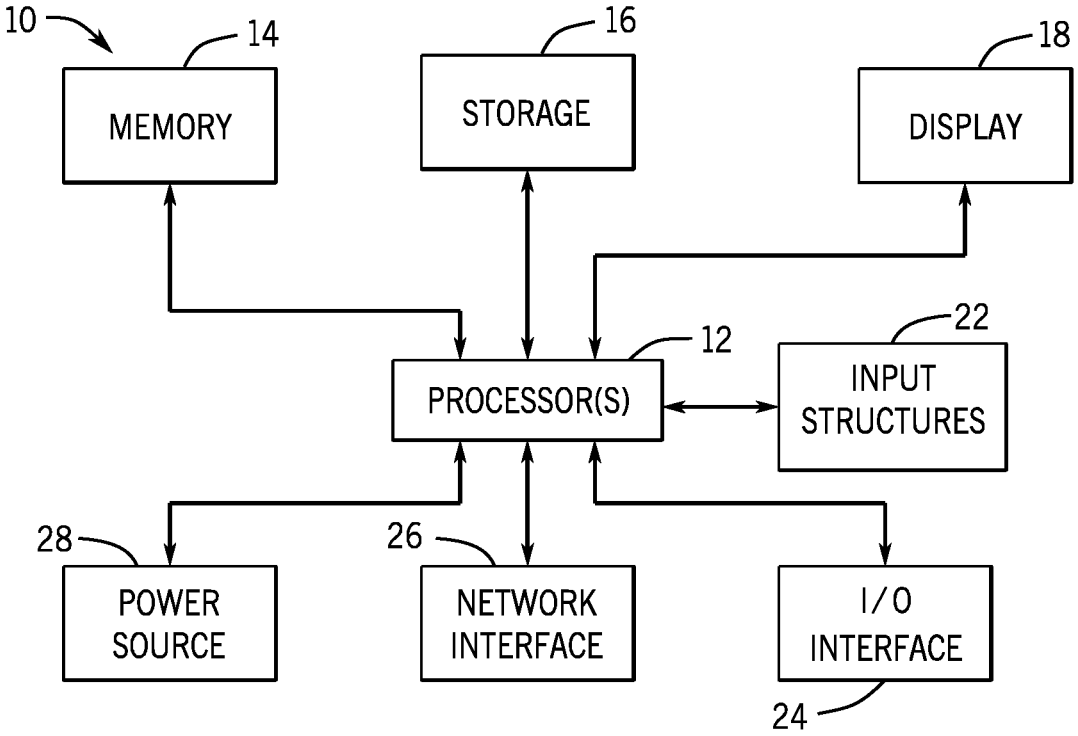
FIG. 1 is a block diagram of an electronic device, in accordance with an embodiment.

Turning first to FIG. 1, an electronic device 10 according to an embodiment of the present disclosure may include, among other things, one or more processor(s) 12, memory 14, nonvolatile storage 16, a display 18, input structures 22, an input/output (I/O) interface 24, a network interface 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
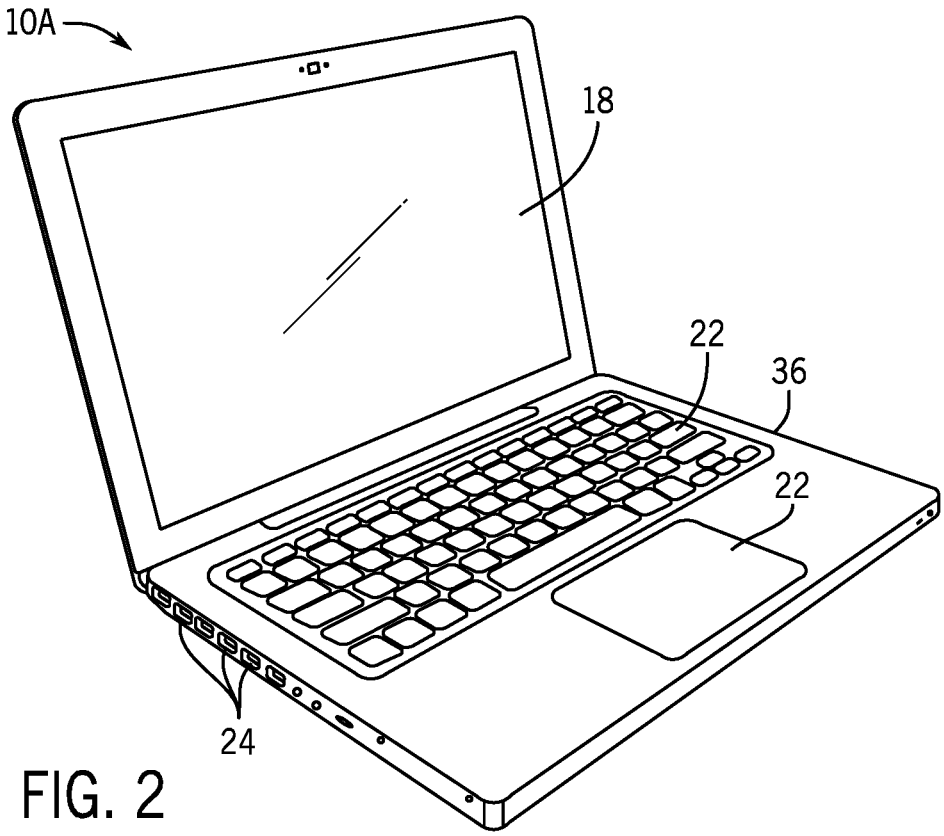
FIG. 2 is a perspective view of a notebook computer representing an embodiment of the electronic device of FIG. 1.
Figure 4:
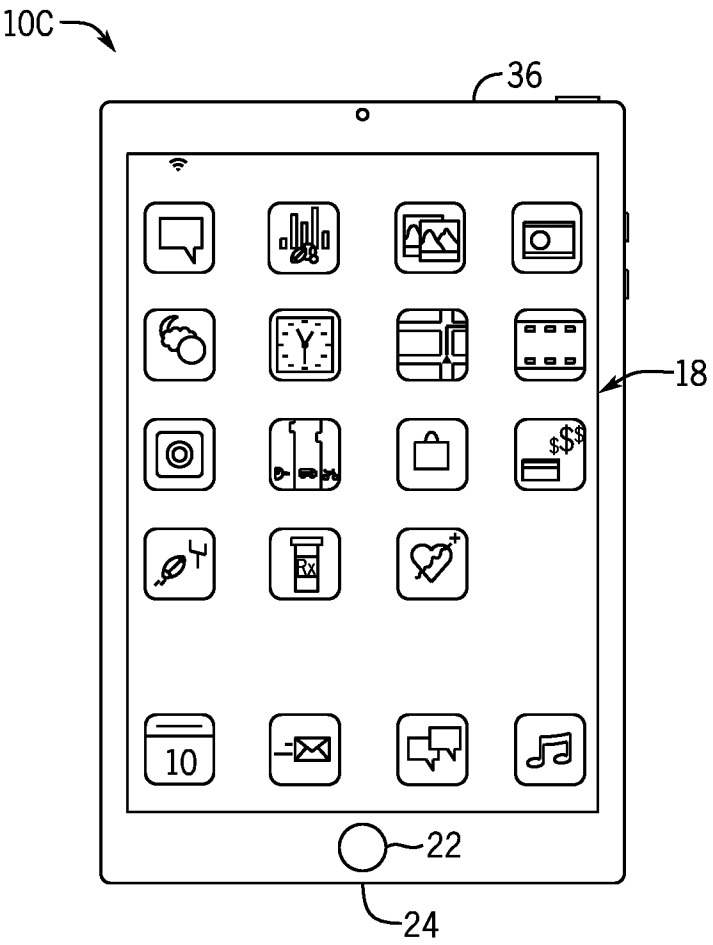
FIG. 4 is a front view of another hand-held device representing another embodiment of the electronic device of FIG. 1.
Figure 3:
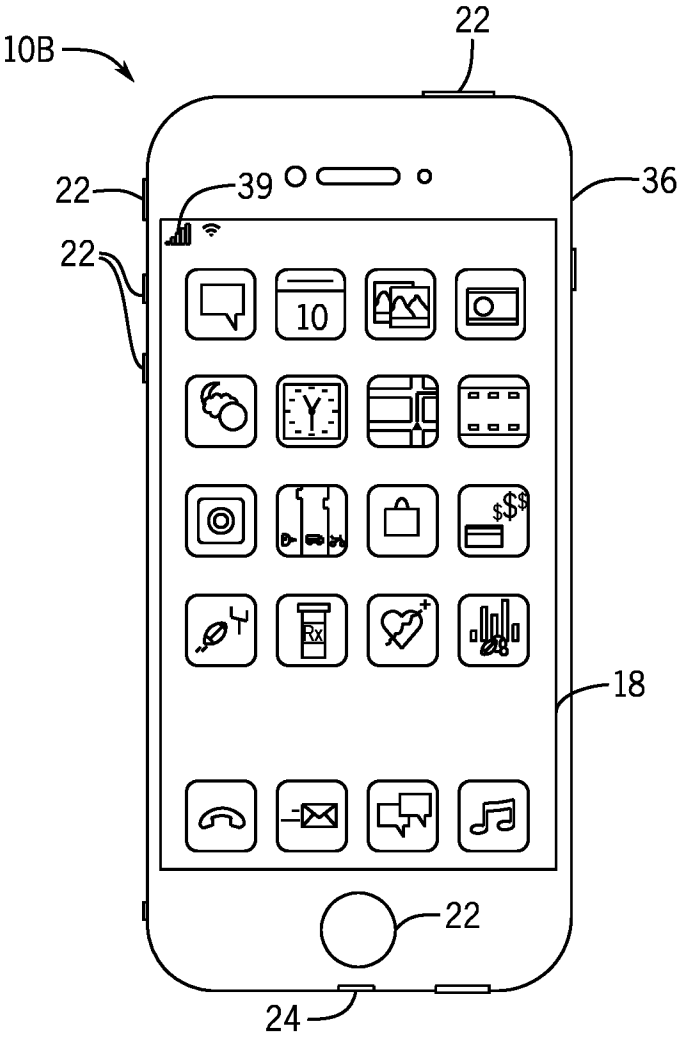
FIG. 3 is a front view of a hand-held device representing another embodiment of the electronic device of FIG. 1.
Figure 5:
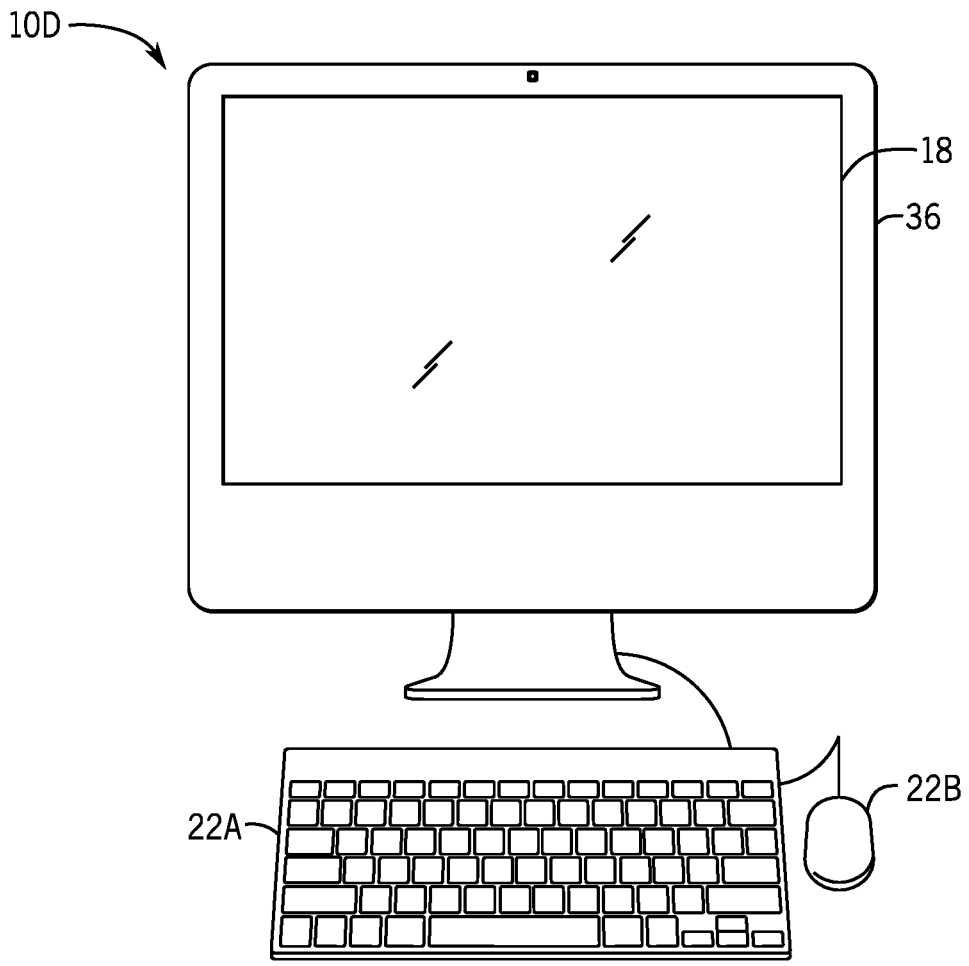
FIG. 5 is a front view of a desktop computer representing another embodiment of the electronic device of FIG. 1.
Figure 6:
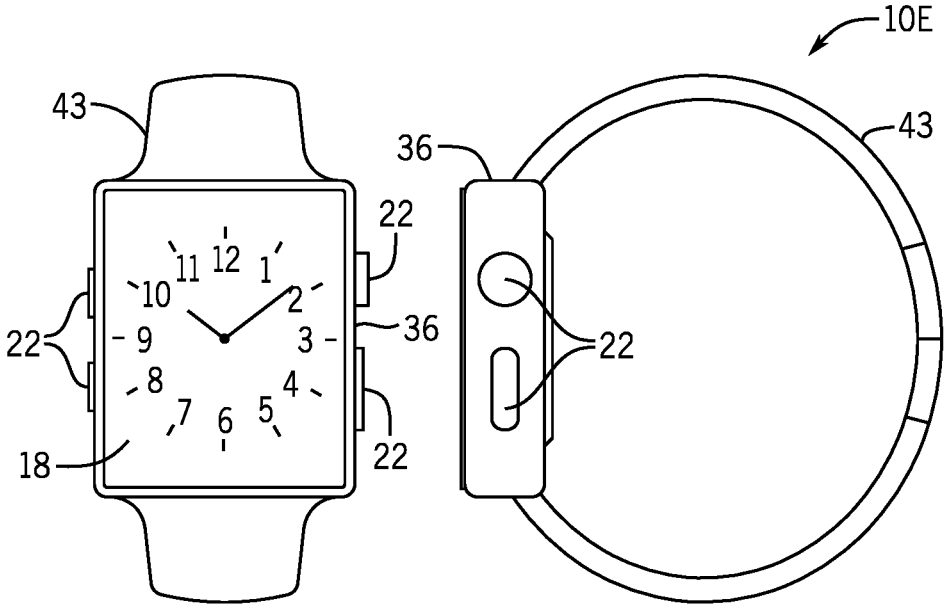
FIG. 6 is a front view and side view of a wearable electronic device representing another embodiment of the electronic device of FIG. 1.

By way of example, the electronic device 10 may represent a block diagram of the notebook computer depicted in FIG. 2, the handheld device depicted in FIG. 3, the handheld device depicted in FIG. 4, the desktop computer depicted in FIG. 5, the wearable electronic device depicted in FIG. 6, or similar devices. It should be noted that the processor(s) 12 and other related items in FIG. 1 may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 may be operably coupled with the memory 14 and the nonvolatile storage 16 to perform various algorithms. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. In addition, programs (e.g., an operating system) encoded on such a computer program product may also include instructions that may be executed by the processor(s) 12 to enable the electronic device 10 to provide various functionalities.

In certain embodiments, the display 18 may be a liquid crystal display (LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (OLED) displays, or some combination of LCD panels and OLED panels.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, one or more interfaces for a personal area network (PAN), such as a Bluetooth network, for a local area network (LAN) or wireless local area network (WLAN), such as an 802.11x Wi-Fi network, and/or for a wide area network (WAN), such as a 3rd generation (3G) cellular network, 4th generation (4G) cellular network, long term evolution (LTE) cellular network, a long term evolution license assisted access (LTE-LAA) cellular network, or the like. The network interface 26 may also include one or more interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra-Wideband (UWB), alternating current (AC) power lines, and so forth. As further illustrated, the electronic device 10 may include a power source 28. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations, and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10 taking the form of a computer 10A, such as a notebook computer, is illustrated in FIG. 2 in accordance with one embodiment of the present disclosure. The depicted computer 10A may include a housing or enclosure 36, a display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

Input structures 22, in combination with the display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer, or one of various portable computing devices. By way of example, the handheld device 10C may be a tablet-sized embodiment of the electronic device 10, which may be, for example, a model of an iPad®, an iPad Pro®, or other similar device by available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the display 18. In certain embodiments, a user of the computer 10D may interact with the computer 10D using various peripheral input devices, such as the keyboard 22A or mouse 22B (e.g., input structures 22), which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The display 18 of the wearable electronic device 10E may include a touch screen display (e.g., LCD, OLED display, active-matrix organic light emitting diode (AMOLED) display, and so forth), as well as input structures 22, which may allow users to interact with a user interface of the wearable electronic device 10E.

Figure 7:
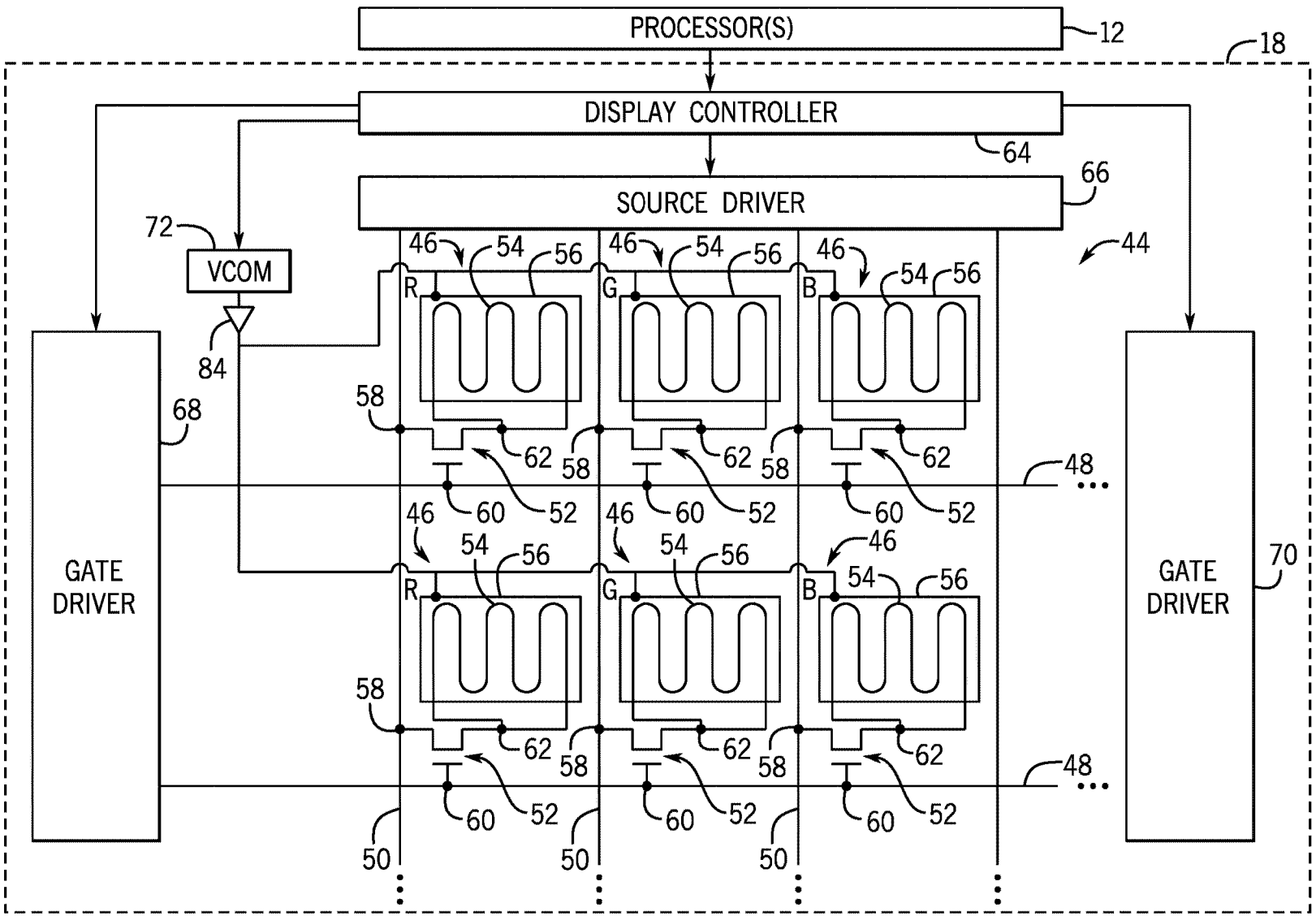
FIG. 7 is a block diagram of a portion of the display of FIG. 1, in accordance with an embodiment.

Turning now to FIG. 7, which generally represents a circuit diagram of certain components of the display 18 in accordance with some embodiments. In particular, a panel 44 of the display 18 (e.g., a display panel) may include a number of unit pixels 46 (e.g., pixels) disposed in a pixel array or matrix. In such an array, each unit pixel 46 may be defined by the intersection of rows and columns, represented by gate lines 48 (also referred to as scanning lines), and data lines 50, respectively. Although only 6 unit pixels 46 are shown for purposes of simplicity, it should be understood that in an actual implementation, each gate line 48 and data line 50 may include hundreds or thousands of such unit pixels 46. Each of the unit pixels 46 may represent one of three subpixels that respectively filters only one color (e.g., red, blue, or green) of light through, for example, a color filter. The terms "pixel," "subpixel," and "unit pixel" may be used largely interchangeably to refer to each individual picture element of the display 18. However, the term "pixel" also sometimes refers to a collection of subpixels that can collectively display any suitable color (e.g., a pixel may be formed from a red subpixel, a green subpixel, and a blue subpixel; collectively, the pixel may be able to display any suitable color that can be formed by mixing red, green, and blue light).

As shown in FIG. 7, each unit pixel 46 may include a thin film transistor (TFT) 52 for switching a data signal stored on a respective pixel electrode 54. However, it should be noted that the VCOM compensation for the display 18 as described herein is not limited to a display 18 using TFT technology, but may instead utilize, for example, another type of LCD display or an OLED display. Returning to FIG. 7, the potential stored on the pixel electrode 54 relative to a potential of a common electrode 56 (e.g., creating a liquid crystal capacitance CsT), which may be shared by other pixels 46, may generate an electrical field sufficient to alter the arrangement of liquid crystal molecules of each unit pixel 46. In the illustrated embodiment of FIG. 7, a source 58 of each TFT 52 may be electrically connected to a data line 50 and a gate 60 of each TFT 52 may be electrically connected to a gate line 48. A drain 62 of each TFT 52 may be electrically connected to a respective pixel electrode 54. Each TFT 52 may serve as a switching element that may be activated and deactivated (e.g., turned "ON" and turned "OFF") for a predetermined period of time based on the respective presence or absence of a scanning signal on the gate lines 48 that are applied to the gates 60 of the TFTs 52.

When activated, a TFT 52 may store the image signals received via the respective data line 50 as a charge upon the corresponding pixel electrode 54. As noted above, the image signals stored by the pixel electrode 54 may be used to generate an electrical field between the respective pixel electrode 54 and a common electrode 56. This electrical field may align the liquid crystal molecules to modulate light transmission through the pixel 46. Furthermore, it should be appreciated that each unit pixel 46 may also include a storage capacitor, or circuitry that may be modeled as a capacitor, which may be used to sustain the pixel electrode voltage (e.g., $V_{pixel}$) during the time in which the TFTs 52 may be switch to the "OFF" state.

In certain embodiments, the display 18 also may include a display controller 64, which may, for example, be an integrated circuit (IC), a chip, such as a processor or application specific integrated circuit (ASIC), or the like that receives image data from the processor(s) 12 and sends corresponding image signals to the a source driver 66 for transmission to unit pixels 46 of the panel 44 along columns of the pixels 46. The display controller 64 may also provide timing signals to the gate drivers 68 and 70 to facilitate the activation/deactivation of individual rows of pixels 46.

The display 18 may additionally include a common voltage (VCOM) source 72 to provide the common voltage (VCOM) to the common electrodes 56 of each of the pixels 46 via one or more VCOM drivers 84 (e.g., driving circuits or drivers). As illustrated, the display controller 64 may be coupled to the VCOM source 72 and may operate to control the VCOM source 72, as will be described in greater detail below.

Figure 8:
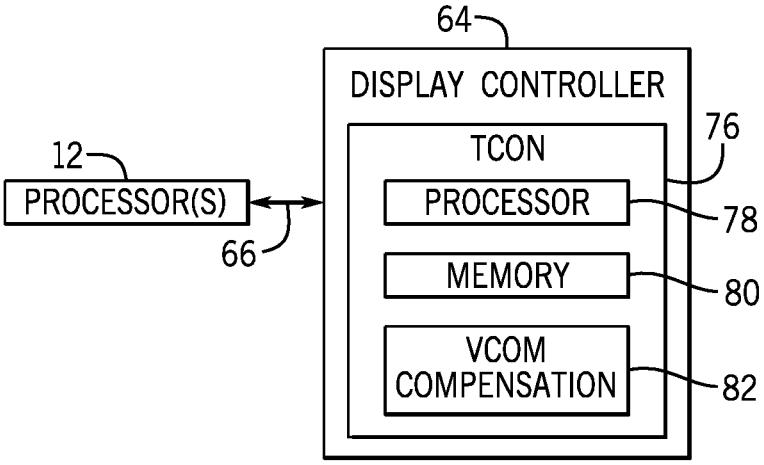
FIG. 8 is a block diagram of a portion of the display controller of FIG. 7, in accordance with an embodiment.

FIG. 8 illustrates the display controller 64 of FIG. 7. As illustrated, the display controller 64 may include, for example, a timing controller (TCON) 76 to facilitate controlling operation of the unit pixels 46 of the panel 44 and, in some embodiments, for example, the VCOM source 72. As illustrated, the timing controller 76 may include a processor 78 and memory 80. More specifically, the processor 78 may execute instructions stored in memory 80 to perform operations in the display 18. Additionally, memory 80 may be a tangible, non-transitory, computer-readable medium that stores instructions executable by and data to be processed by the processor 78. The TCON 76 may also include VCOM compensation circuitry 82 that operates to generate signals for transmission to the VCOM source 72. In some embodiments, the VCOM compensation circuitry 82 may operate as a controller used to generate pulse signals that are transmitted to the VCOM source 72 as input signals (e.g., input pulse signals) to allow the VCOM source 72 to generate and transmit waveforms (e.g., voltage levels) to drivers associated with the VCOM source 72 and the display 18. The pulse signal(s) transmitted from the VCOM compensation circuitry 82 and/or the TCON 76 may be a synchronization signal that operates to set the start of a VCOM compensation, e.g., so that the TCON 76 controls synchronization of a VCOM compensation waveform generation and/or transmission (e.g., a waveform transmitted as an output from the VCOM source 72) with gate line-by-line scanning of the panel 44.

In other embodiments, the VCOM compensation circuitry 82 may operate as a lookup table to be used by the processor 78 in determining and generating pulse signals that are transmitted to the VCOM source 72 as input signals to allow the VCOM source 72 to generate and transmit waveforms (e.g., voltage levels) to drivers associated with the VCOM source 72 and the display 18 which may be, for example, synchronized with gate line-by-line scanning operations. Additionally or alternatively to location within the TCON 76, the VCOM compensation circuitry 82 may located within systems on chips (SoC) and/or column drivers of the electronic device 10. Furthermore, in certain embodiments, VCOM compensation instructions may be stored in the memory 20 to be executed by the processor 12 to compensate for VCOM fluctuations.

Figure 9:
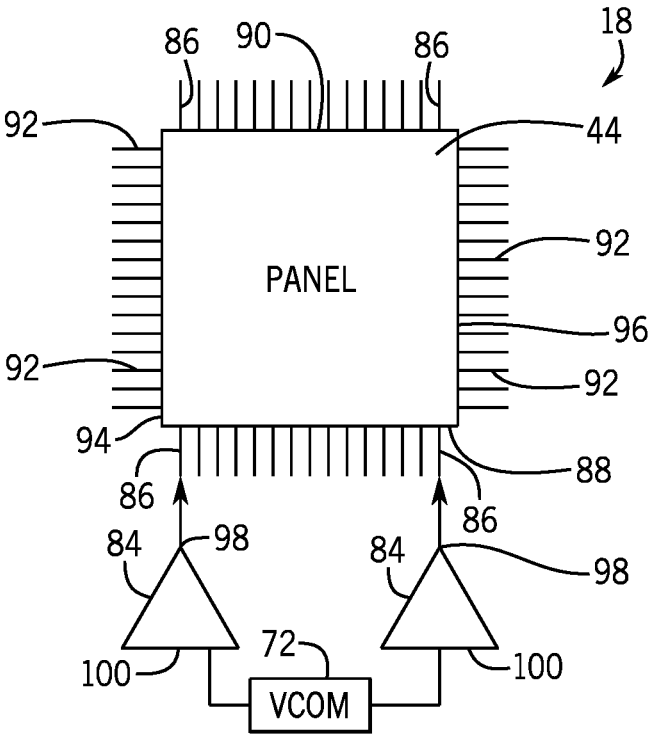
FIG. 9 is a block diagram of a portion of the display of FIG. 1, in accordance with an embodiment.

As illustrated in FIG. 9, the display 18 may include the panel 44, the VCOM source 72, as well as one or more VCOM drivers 84 (e.g., driving circuits or drivers). The VCOM drivers 84 (e.g., the one or more VCOM drivers 84) may be buffers or amplifiers that operate to drive respective portions of the panel 44. The panel 44 includes connection points 86 (e.g., inputs) on a first side 88 and on a second side 90 of the panel 44 that correspond to a vertical direction. Similarly, the panel 44 includes connection points 92 (e.g., inputs) on a third side 94 and on a fourth side 96 of the panel 44 that correspond to a horizontal direction. It should be noted that the example in FIG. 9 is for illustrative purposes only and other panel 44 shapes (e.g., circular, triangular, pentagon, hexangular, etc) can be utilized in place of the illustrated panel 44. Similarly, the one or more VCOM drivers 84 can be positioned at any location on and/or along any side of the panel 44 as illustrated or when having a different shape.

As illustrated, the VCOM drivers 84 have an output 98 that is coupled to the connection points 86 on the first side 88 of the panel 44 to drive waveforms (e.g., voltage signals) to the pixels 46, as previously described with respect to FIG. 7. However, again, it should be noted that FIG. 9 is for illustrative purposes and that the one or more VCOM drivers 84 can located anywhere on and/or along the panel 44 and, similarly, the output 98, although illustrated as being coupled to the connection points 86 of the panel 44, can also be disposed anywhere on and/or along the panel 44. Indeed, VCOM drivers 84 and their corresponding output(s) 98 are not required to be disposed along a single edge of the panel 44 or at a common location of the panel 44.

Likewise, the VCOM drivers 84 include an input 100 that receives waveform signals (e.g., voltage signals) from the VCOM source 72. As illustrated, two VCOM drivers 84 are disposed on the first side 88 of the panel 44 to drive waveforms (e.g., voltage signals) to the pixels 46, however, it may be appreciated that a single VCOM driver 84 may be employed or more than two VCOM drivers 84 may be utilized along the first side 88 of the panel 44 as well as in other locations along the panel 44, as will be described below in greater detail.

In operation, the VCOM source 72 may dynamically adjust the VCOM transmitted via the VCOM drivers 84 to compensate for VCOM non-uniformity across the panel 44. In some embodiments, the VCOM source 72 may generate one or more output waveforms (e.g., a voltage signal or voltage signals) that may be transmitted to the VCOM drivers 84 to be input into the panel 44 (e.g., to be provided as the VCOM to the common electrodes 56 of the pixels 46). The output waveform may be generated internally by the VCOM source 72 based upon a pulse signal transmitted from the TCON 76 (e.g., one or more pulse signals transmitted from the TCON 76 and/or the VCOM compensation circuitry 82, as described above with respect to FIG. 8). For example, a pulse signal may be received as an input signal at the VCOM source 72 and the VCOM source 72 may select a predetermined saved output waveform to output to the VCOM drivers 84 based upon the received pulse signal. Likewise, in some embodiments, the VCOM source 72 may include a processor and corresponding memory that operate to receive the pulse signal and generate (e.g., calculate or determine) an output waveform to output to the VCOM drivers 84 based upon the waveform pulse. Alternatively, the pulse signal may be generated via the TCON 76 (e.g., by or in conjunction with the VCOM compensation circuitry 82) and transmitted inclusive of waveform information itself (e.g., information related to, identifying, or otherwise indicative of the output waveform) as part of the pulse signal transmitted to the VCOM source 72 to be utilized in the generation of the waveform VCOM (e.g., output waveform) transmitted to the VCOM driver(s) 84. Likewise, in some embodiments, one or more of these techniques may be utilized with the TCON 76 including the VCOM source 72 or performing the above noted functions of the VCOM source 72.

In some embodiments, the output waveform (e.g., the common voltage) transmitted to the VCOM drivers 84 and, accordingly, the panel 44 and may be varied on a line-to-line basis (e.g., at groupings of pixels 46 grouped together in lines) to allow for driving of the VCOM to particular levels associated with the various lines of pixels 46 of the display 18 to provide local VCOM levels for pixels 46 of a line of the panel 44. Likewise, the TCON 76 and/or the VCOM source 72 may operate to synchronize the VCOM line-to-line adjustment to the scanning signal transmitted to the gate lines 48 (e.g., the scanning lines), so that only the active pixel 46 of a line of pixels 46 receives the locally compensated VCOM. That is, the pixels 46 of a line may each receive the VCOM as in input, but only the pixel 46 of the line of pixels 46 that also receives a scanning signal with the VCOM allows causes activation of the pixel 46 and, accordingly, utilizes the VCOM. Furthermore, in some embodiments, the VCOM drivers 84 may operate cooperatively and/or simultaneously to generate a VCOM in conjunction with a gate scan (e.g., to dynamically change the VCOM in conjunction with the gate scanning of the panel 44). This process is further illustrated with respect to FIGS. 10 and 11.

Figure 10:
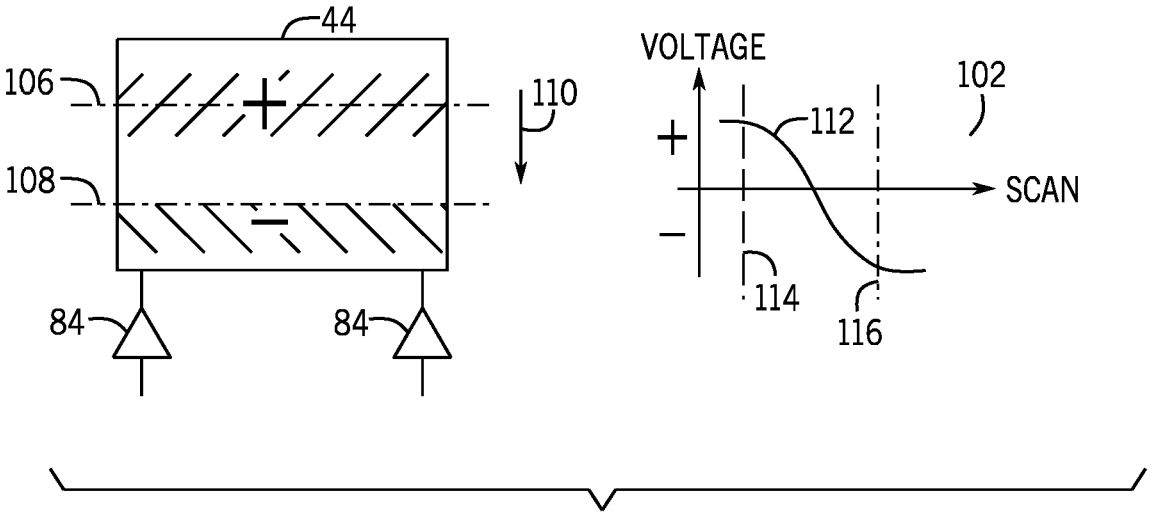
FIG. 10 illustrates a second block diagram of a portion of the display of FIG. 1 and an associated first graph illustrating a one dimensional VCOM compensation being applied thereto, in accordance with an embodiment.
Figure 11:
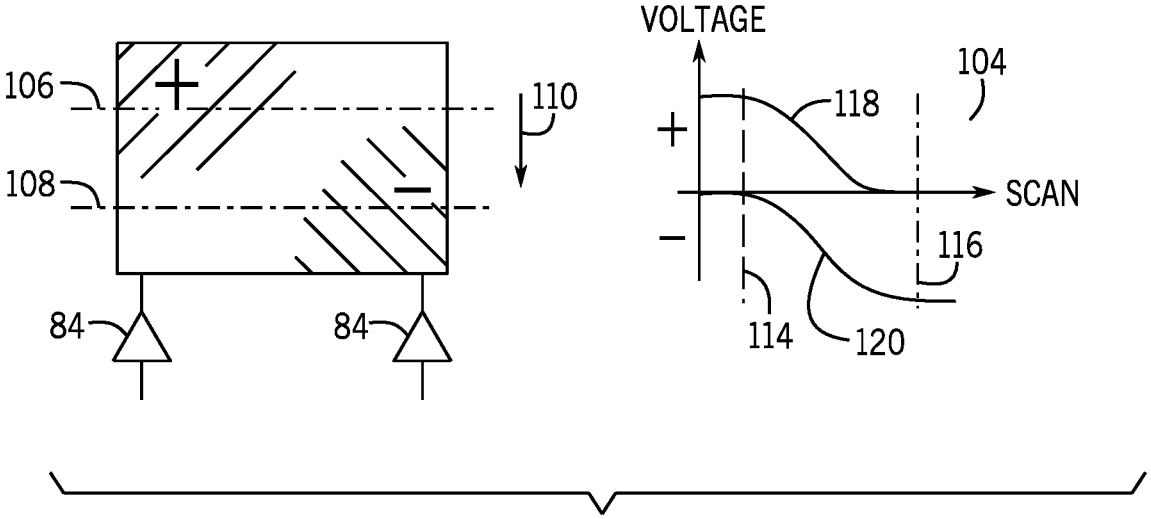
FIG. 11 illustrates a third block diagram of a portion of the display of FIG. 1 and an associated second graph illustrating a two dimensional VCOM compensation being applied thereto, in accordance with an embodiment.

FIG. 10 illustrates a panel 44 having a 1D (e.g., one dimensional) VCOM compensation (e.g., in a vertical direction) applied thereto, as further illustrated in graph 102. Similarly, FIG. 11 illustrates a panel 44 having a 2D (e.g., two dimensional) VCOM compensation (e.g., in a horizontal direction and in a vertical direction) applied thereto, as further illustrated in graph 104. As illustrated in each of FIGS. 10 and 11, a panel 44 includes a representative first line 106 of pixels 46 being driven via a positive voltage value and a second line 108 of pixels 46 being driven via a negative voltage value during a scan 110 of the panel 44 whereby the voltage values, for example, have the same absolute value. However, as noted above, in FIG. 10, the panel 44 is illustrated as having a 1D VCOM compensation applied thereto.

Graph 102 of FIG. 10 illustrates a waveform 112 may be applied to both of the drivers 84 of FIG. 10 (e.g., the waveform 112 may represent a single waveform that is generated and transmitted to both of the drivers 84 having separate connection points 86, for example, or the waveform 112 may represent separate waveforms having the same voltage level that are generated and transmitted to both of the drivers 84 having separate connection points 86, for example). Additionally graph 102 illustrates a portion 114 of the scan 110 associated with the first line 106 of pixels 46 and a portion 116 of the scan 110 associated with the second line 108 of pixels 46. Furthermore, no matter where the drivers 84 are positioned along panel 44 in FIG. 10, the driving signal (e.g., waveform 112 as the output waveform from VCOM source 72) applied to each of the drivers 84 provides for 1D VCOM compensation. The 1D VCOM compensation may, for example, be in a direction along a gate scan direction (e.g., illustrated by scan 110 as progressing downwards across the panel 44), so that if the panel 44 is scanning from top to bottom (or from bottom to top), vertical non-uniformity associated with the panel 44 may be compensated. Similarly, if the panel 44 scan 110 is from left to right (or from right to left) across the panel 44, horizontal non-uniformity associated with the panel 44 may be compensated.

In FIG. 11, the panel 44 is illustrated as having a 2D VCOM compensation applied thereto. Graph 104 illustrates a waveform 118 that is applied to one of the drivers 84 of FIG. 11 (e.g., the leftmost driver 84 of FIG. 11). Likewise, graph 104 also illustrates a waveform 120 that is applied to the other one of the drivers 84 of FIG. 11 (e.g., the rightmost driver 84 of FIG. 11). Thus, as illustrated in FIG. 11, no matter where the drivers 84 are positioned along panel 44, the driving signals (e.g., waveforms 118 and 120 as the output waveforms from VCOM source 72) provide 2D VCOM compensation through an integrated effect generated by the driving of different waveforms via the different drivers 84 at each time in the scan 110 to generate a composite VCOM waveform (e.g., a resultant VCOM based upon via the individually driven waveforms 118 and 120 as the VCOM applied to the panel 44).

In some embodiments, for 2D VCOM compression, the position of drivers 84 influences the VCOM compensation (e.g., the result of the 2D VCOM compression). For example, the drivers 84 work in conjunction during 2D VCOM compression, so their positioning will affect how the voltages from the different drivers 84 are integrated on the panel 44. For example, if the driver 84 locations illustrated in FIG. 11 were reversed while waveforms 118 and 120 remained the same, the resultant VCOM (e.g., the VCOM compensation) will be different (e.g., the bottom left portion of panel 44 would be negative while the top right portion of the panel 44 would be positive).

FIG. 10 and FIG. 11 are intended to provide respective examples for 1D VCOM compensation and 2D VCOM compensation, respectively. However, dynamic VCOM compensation as described herein may be, for example, utilized to compensate for a number of types of for VCOM non-uniformities of the panel 44 (e.g., and is not limited to the panel 44 VCOM non-uniformity as illustrated in FIG. 10 and FIG. 11). Similarly, the compensation waveforms generated may be any number of types of waveforms generated for the compensation to be undertaken and are, for example, not limited to the waveforms 112, 118, and 120 of FIG. 10 and FIG. 11).

Furthermore, with respect to VCOM 1D compensation, it is a common waveform (e.g., waveform 112 or another waveform) that is applied to one or more buffers 84 driving at one or more locations along or on the panel 44 to compensate for VCOM non-uniformity along the gate scanning direction. Likewise, for VCOM 2D compensation, there are two or more waveforms (e.g., waveforms 118 and 120 or other waveforms) that are applied to two or more buffers 84 driving at two or more locations along or on the panel 44 simultaneously to create an integrated effect to compensate for any arbitrary 2D VCOM non-uniformity of the panel 44.

Returning to FIG. 9, the location of the illustrated VCOM drivers 84 on the first side 88 of the panel 44 is intended to be for illustrative purposes only. Indeed, it should be appreciated that multiple VCOM drivers 84 along connection points 86 and/or connection points 92 can be utilized anywhere on the outside region of the panel 44 (or in an internal region of the panel 44) to provide VCOM compensation. FIGS. 12-16 provide examples of locating VCOM drivers 84 along differing portions of a panel 44 to allow for different VCOM compensation outputs to be utilized.

Figure 12:
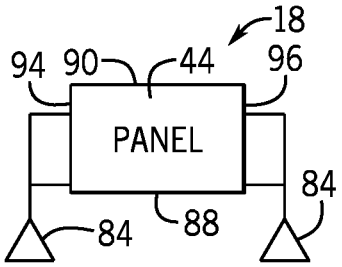
FIG. 12 is a fourth flock diagram of a portion of the display of FIG. 1, in accordance with an embodiment.

As illustrated in FIG. 12, the display 18 may include VCOM drivers 84 that may be coupled to the third side 94 of the panel 44 at two connection points 92 and VCOM drivers 84 may be coupled to the fourth side 96 of the panel 44 at two different connection points 92. As illustrated, the VCOM driver 84 coupled to the third side 94 of the panel 44 receive an output waveform and the VCOM driver 84 coupled to the fourth side 96 of the panel 44 may receive an output waveform (which may be the same or different than the output waveform received by the VCOM driver 84 coupled to the third side 94 of the panel 44). In total, the VCOM drivers 84 will transmit the received output waveforms into the panel 44 (as illustrated, via separate connection points 92 on each of the third side 94 of the panel 44 and the fourth side 96 of the panel 44) resulting in an adjusted VCOM being supplied to the gate activated pixel 46 of a particular line of pixels 46.

Figure 13:
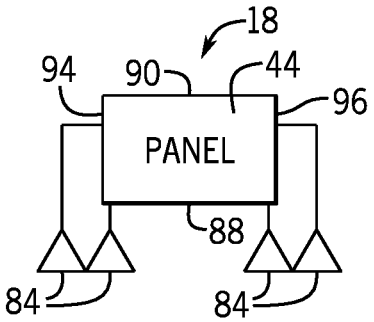
FIG. 13 is a fifth block diagram of a portion of the display of FIG. 1, in accordance with an embodiment.

FIG. 13 illustrates the display 18 having two VCOM drivers 84 that may be coupled to the third side 94 of the panel 44 at two connection points 92 and two VCOM drivers 84 may be coupled to the fourth side 96 of the panel 44 at two different connection points 92. The VCOM drivers 84 coupled to the third side 94 of the panel 44 may each receive the same or different output waveforms and the VCOM drivers 84 coupled to the fourth side 96 of the panel 44 may each receive the same or different output waveform (which may themselves be the same or different than the output waveform(s) received by the VCOM drivers 84 coupled to the third side 94 of the panel 44). In total, the VCOM drivers 84 will transmit the respective received output waveforms into the panel 44 resulting in an adjusted VCOM being supplied to the gate activated pixel 46 of a particular line of pixels 46.

Figure 14:
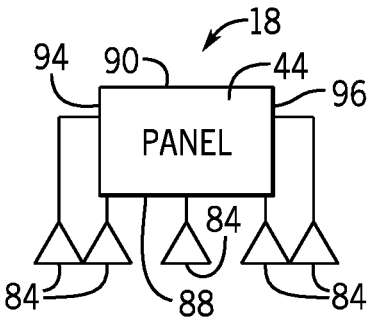
FIG. 14 is a sixth block diagram of a portion of the display of FIG. 1, in accordance with an embodiment.

FIG. 14 illustrates the display 18 having three VCOM drivers 84 that may be coupled to the first side 88 of the panel at separate connection points 86, a VCOM driver 84 that is coupled to the third side 94 of the panel 44 at a connection point 92, and a VCOM driver 84 coupled to the fourth side 96 of the panel 44 at a connection point 92. The VCOM drivers 84 coupled to the first side 88 of the panel 44 may each receive the same or different output waveforms, the VCOM driver 84 coupled to the third side 94 may receive an output waveform, and the VCOM driver 84 coupled to the fourth side 96 of the panel 44 may receive an output waveform (which may themselves be the same or different than the output waveform(s) received by the VCOM drivers 84 coupled to the first side 88 of the panel 44). In total, the VCOM drivers 84 will transmit the respective received output waveforms into the panel 44 resulting in an adjusted VCOM being supplied to the gate activated pixel 46 of a particular line of pixels 46.

Figure 15:
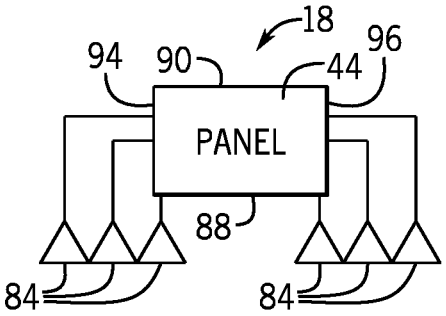
FIG. 15 is a seventh block diagram of a portion of the display of FIG. 1, in accordance with an embodiment.

FIG. 15 illustrates the display 18 having two VCOM drivers 84 that may be coupled to the first side 88 of the panel at separate connection points 86, two VCOM drivers 84 that are coupled to the third side 94 of the panel 44 at separate connection points 92, and two VCOM driver 84 coupled to the fourth side 96 of the panel 44 at separate connection points 92. The VCOM drivers 84 coupled to the first side 88 of the panel 44 may each receive the same or different output waveforms, the VCOM drivers 84 coupled to the third side 94 may each receive the same or different output waveforms, and the VCOM drivers 84 coupled to the fourth side 96 of the panel 44 may each receive the same or different output waveforms (which may themselves be the same or different than the output waveform(s) received by the VCOM drivers 84 coupled to the first side 88 of the panel 44). In total, the VCOM drivers 84 will transmit the respective received output waveforms into the panel 44 resulting in an adjusted VCOM being supplied to the gate activated pixel 46 of a particular line of pixels 46.

Figure 16:
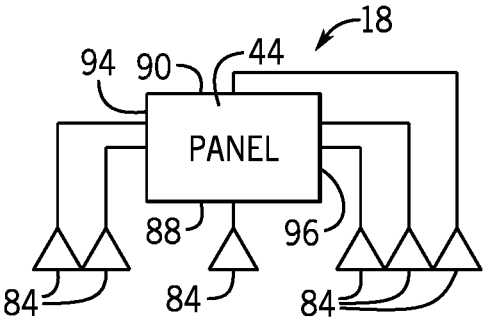
FIG. 16 is an eighth block diagram of a portion of the display of FIG. 1, in accordance with an embodiment.

FIG. 16 illustrates the display 18 having three VCOM drivers 84 that may be coupled to the first side 88 of the panel at separate connection points 86, a VCOM driver 84 that is coupled to the second side 90, a VCOM driver that is coupled to the third side 94 of the panel 44, and a VCOM driver 84 that is coupled to the fourth side 96 of the panel 44. The VCOM drivers 84 coupled to the first side 88 of the panel 44 may each receive the same or different output waveforms, and the VCOM drivers 84 coupled to the second side 90, the third side 94, and the fourth side 96 may each receive the same or different output waveforms which themselves may be the same or different than the output waveform(s) received by the VCOM drivers 84 coupled to the first side 88 of the panel 44). In total, the VCOM drivers 84 will transmit the respective received output waveforms into the panel 44 resulting in an adjusted VCOM being supplied to the gate activated pixel 46 of a particular line of pixels 46.

In some embodiments, information may be collected and utilized to formulate waveforms (e.g., waveform 112, waveform 118, waveform 120, and/or additional waveforms) that may be stored (e.g., in a lookup table as stored waveforms) to be transmitted to the VCOM drivers 84. Collection of this information may be part of, for example, a factory calibration of the electronic device 10, an internal calibration of the electronic device 10 performed, for example, when the electronic device is powered on or restarted, or the information may be collected in a different manner. The information may be, for example, utilized to generate VCOM compensation and/or a VCOM compensation map of the display 18 that may be utilized in determining and generating the VCOM waveforms that are transmitted to the VCOM drivers 84 to adjust the VCOM for selected pixels 46.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A display, comprising:

a plurality of pixels grouped into a plurality of lines of pixels, wherein each line of pixels of the plurality of lines of pixels comprises a group of pixels of the plurality of pixels coupled to a common scan line and coupled to different data lines to individually activate each pixel of the group of pixels; and a common voltage (VCOM) driving circuit configured to receive at least a first waveform and a second waveform that are predetermined and to drive the first waveform and the second waveform to the display as respective VCOM values tailored to a first pixel and a second pixel of the group of pixels, wherein the first waveform is associated with the first pixel and the second waveform is associated with the second pixel, such that the VCOM driving circuit uses the respective VCOM values for the first pixel and the second pixel when each respective pixel is activated.

2. The display of claim 1, comprising a VCOM source coupled to the VCOM driving circuit, wherein the VCOM source is configured to generate the first waveform and the second waveform and transmit the first waveform and the second waveform to the VCOM driving circuit.

3. The display of claim 2, wherein the VCOM source is configured to receive an input pulse signal and determine the first waveform based upon the input pulse signal.

4. The display of claim 3, comprising a timing controller coupled to the VCOM source, wherein the timing controller is configured to generate and transmit the input pulse signal.

5. The display of claim 3, wherein the VCOM source is configured to determine the first waveform by retrieving a stored waveform that is selected based upon the input pulse signal.

6. The display of claim 3, wherein the VCOM source is configured to dynamically generate the first waveform based upon the input pulse signal.

7. The display of claim 2, wherein the VCOM source is configured to receive an input pulse signal and generate the first waveform based upon the input pulse signal.

8. The display of claim 7, comprising a timing controller coupled to the VCOM source, wherein the timing controller is configured to generate and transmit the input pulse signal as including waveform information related to the first waveform.

9. The display of claim 1, comprising a second VCOM driving circuit configured to receive a third waveform and a fourth waveform and drive the third waveform and the fourth waveform to the display in conjunction with the first waveform and the second waveform driven by the VCOM driving circuit as the respective VCOM values tailored to the first pixel and the second pixel of the group of pixels to generate a composite VCOM waveform tailored to the first pixel and the second pixel of the group of pixels.

10. The display of claim 1, comprising a second VCOM driving circuit configured to receive a third waveform and drive the third waveform to the display in conjunction with the first waveform driven by the VCOM driving circuit as the respective VCOM value tailored to the first pixel.

11. The display of claim 10, comprising a VCOM source coupled to each of the VCOM driving circuit and the second VCOM driving circuit, wherein the VCOM source is configured to generate the first waveform and transmit the first waveform to the VCOM driving circuit, wherein the VCOM source is configured to generate the third waveform and transmit the third waveform to the second VCOM driving circuit.

12. The display of claim 11, wherein the VCOM source is configured to generate the third waveform as having a same voltage level as the first waveform.

13. The display of claim 1, wherein the VCOM driving circuit is configured to drive the first waveform to at least two separate connection points of the display as the respective VCOM value tailored to the first pixel of the group of pixels.

14. An electronic display, comprising:

a plurality of pixels;

a first common voltage (VCOM) driving circuit configured to:

receive at least a first and a second waveform that are predetermined as respective VCOM values tailored to a first pixel and a second pixel of the plurality of pixels, such that the first VCOM driving circuit uses the respective VCOM values for the first pixel and the second pixel when each respective pixel is activated;

provide a first portion of a first common voltage to a common electrode of the first pixel based at least in part on the first waveform when the first pixel is activated; and provide a first portion of a second common voltage to a common electrode of the second pixel based at least in part on the second waveform when the second pixel is activated; and a second VCOM driving circuit configured to:

provide a second portion of the first common voltage to the common electrode of the first pixel when the first pixel is activated; and provide a second portion of the second common voltage to the common electrode of the second pixel when the second pixel is activated, wherein the first common voltage is selected to have a voltage level associated with the first pixel and the second common voltage is selected to have a voltage level associated with the second pixel.

15. The electronic display of claim 14, comprising a panel having at least a first and a second side, wherein the first VCOM driving circuit and the second VCOM driving circuit are coupled to the first side of the panel.

16. The electronic display of claim 14, comprising a panel having at least a first and a second side, wherein the first VCOM driving circuit is coupled to the first side of the panel and wherein the second VCOM driving circuit is coupled to the second side of the panel.

17. The electronic display of claim 14, wherein the first VCOM driving circuit is configured to provide the first portion of the first common voltage as having a first voltage value, wherein the second VCOM driving circuit is configured to provide the second portion of the first common voltage as having the first voltage value.

18. The electronic display of claim 14, comprising a timing controller configured to synchronize transmission of a scanning signal to the first pixel with the first VCOM driving circuit providing the first portion of the first common voltage to the common electrode of the first pixel and with the second VCOM driving circuit providing the second portion of the first common voltage to the common electrode of the first pixel of the plurality of pixels when the first pixel is activated.

19. A display, comprising:

a timing controller configured to:

generate a pulse scanning signal utilized to control timing of a scan of the display;

generate a first pulse signal that is synchronized with the pulse scanning signal to generate a first waveform that is predetermined and driven to the display as a first common voltage (VCOM) value tailored to a first pixel in conjunction with the scan of the display, wherein the first waveform is associated with the first pixel, such that the first VCOM value is driven to the first pixel when the first pixel is activated; and generate a second pulse signal pulse signal that is synchronized with the pulse scanning signal to generate a second waveform that is predetermined and driven to the display as a second common voltage (VCOM) value tailored to a second pixel in conjunction with the scan of the display, wherein the second waveform is associated with the second pixel, such that the second VCOM value is driven to the second pixel when the second pixel is activated.

20. The display of claim 19, wherein the timing controller is configured to generate a third pulse signal that is synchronized with the pulse scanning signal to generate a third waveform driven to the display as a third VCOM value tailored to a third pixel of the display in conjunction with the scan of the display.

* * * * *